US011434027B2

(12) United States Patent
Anatrini

(10) Patent No.: US 11,434,027 B2
(45) Date of Patent: Sep. 6, 2022

(54) MACHINE FOR FILLING AND CLOSING PHARMACEUTICAL CONTAINERS, SUCH AS SYRINGES, VIALS AND THE LIKE

(71) Applicant: MARCHESINI GROUP S.p.A., Pianoro (IT)

(72) Inventor: Dario Anatrini, Siena (IT)

(73) Assignee: Marchesini Group S.p.A., Pianoro (IT)

( * ) Notice: Subject to any disclaimer, the term of this patent is extended or adjusted under 35 U.S.C. 154(b) by 192 days.

(21) Appl. No.: 16/980,556

(22) PCT Filed: Mar. 15, 2019

(86) PCT No.: PCT/IB2019/052115
§ 371 (c)(1),
(2) Date: Sep. 14, 2020

(87) PCT Pub. No.: WO2019/186318
PCT Pub. Date: Oct. 3, 2019

(65) Prior Publication Data

US 2021/0002007 A1 Jan. 7, 2021

(30) Foreign Application Priority Data

Mar. 29, 2018 (IT) ..... 102018000004068

(51) Int. Cl.
*B65B 3/00* (2006.01)
*A61J 1/05* (2006.01)
(Continued)

(52) U.S. Cl.
CPC ..... *B65B 3/003* (2013.01); *A61J 1/05* (2013.01); *B65B 7/16* (2013.01); *B65B 43/54* (2013.01)

(58) Field of Classification Search
CPC ..... B65B 3/003; B65B 7/16; B65B 43/54; B65B 55/025–027; A61J 1/05
See application file for complete search history.

(56) References Cited

U.S. PATENT DOCUMENTS 5,577,367 A * 11/1996 Abrams ..... B65B 25/008 53/425
2004/0060261 A1* 4/2004 Py ..... B65B 3/04 53/425

(Continued)

FOREIGN PATENT DOCUMENTS

EP 2599721 A2 6/2013
WO WO99/45985 A1 9/1999

(Continued)

*Primary Examiner* — Anna K Kinsaul
*Assistant Examiner* — Himchan Song
(74) *Attorney, Agent, or Firm* — R. Neil Sudol; Henry Coleman

(57) ABSTRACT

A machine for filling and closing pharmaceutical containers disposed in respective supports has a sterile first work environment with an inlet passage and an outlet passage, a conveyor transporting the supports, which crosses the work environment through the inlet passage and the outlet passage, and a collecting station in the work environment, for collecting and extracting the containers from the supports. The work environment has a second outlet passage. A sterile second work environment has an inlet and an outlet, the inlet being at the second outlet passage of the first work environment to define a common passage. Another conveyor passes through the common passage, has a first part in the first work environment and a second part in the second work environment, and is predisposed so that the first part can receive the containers and convey them through the common passage at a filling station and a closing station.

6 Claims, 5 Drawing Sheets

(51) Int. Cl.
*B65B 7/16* (2006.01)
*B65B 43/54* (2006.01)

(56) References Cited

U.S. PATENT DOCUMENTS

| | | | | |
|---|---|---|---|---|
| 2007/0214748 | A1* | 9/2007 | Dovesi | B65B 55/10 53/510 |
| 2009/0022863 | A1* | 1/2009 | Lagerstedt | A23L 3/04 426/393 |
| 2009/0120041 | A1* | 5/2009 | Trebbi | B65B 37/00 198/358 |
| 2011/0302883 | A1* | 12/2011 | Monti | B65B 43/42 53/281 |
| 2012/0090268 | A1* | 4/2012 | Krauss | B65B 3/003 53/281 |
| 2013/0283733 | A1* | 10/2013 | Py | B65B 51/02 53/425 |
| 2014/0157731 | A1* | 6/2014 | Perazzo | B65B 3/003 141/2 |
| 2015/0034208 | A1* | 2/2015 | Chang | B05B 15/55 141/2 |
| 2018/0162572 | A1* | 6/2018 | Trilli | B65B 55/027 |
| 2018/0229866 | A1* | 8/2018 | Eberhardt | B65B 65/003 |
| 2018/0339796 | A1* | 11/2018 | Bai | B65B 65/003 |
| 2019/0315004 | A1* | 10/2019 | Bechini | B65B 43/54 |

FOREIGN PATENT DOCUMENTS

| | | | |
|---|---|---|---|
| WO | WO2004/076288 | A1 | 9/2004 |
| WO | WO2016/198391 | A1 | 12/2016 |

* cited by examiner

MACHINE FOR FILLING AND CLOSING PHARMACEUTICAL CONTAINERS, SUCH AS SYRINGES, VIALS AND THE LIKE

FIELD OF THE INVENTION

The present invention relates to the technical sector concerning the packaging of substances of pharmaceutical substances or products internally of relative containers, in particular syringes, vials and the like.

In this particular technical sector it is necessary to carry out the filling and closing operations of the pharmaceutical containers in controlled-atmosphere environments, in particular sterile environments, to avoid any contamination of the pharmaceutical substance or product.

DESCRIPTION OF THE PRIOR ART

It is known that pharmaceutical containers that have to be filled are usually predisposed in groups and inserted internally of relative support elements which are then packed internally of sterile packages.

The sterile packages are then supplied to pharmaceutical producers which arrange machines for carrying out the filling of the containers with the pharmaceutical substances or products and the subsequent closure thereof.

According to types of pharmaceutical containers, and the reciprocal arrangement thereof in the formation of the groups, various types of support elements can be used.

For example, in the case of pharmaceutical containers constituted by vials, the support elements can be constituted by trays and vials arranged internally of the trays with a mouth, facing downwards, for inserting the pharmaceutical substance or product.

In this case, the trays are arranged on the relative bottom of a sort of grid having a series of seatings or housings for internally receiving the mouths of the vials, and guaranteeing the stability thereof in the tray.

The trays with the vials arranged internally of them are then sealed using a protective film, and then packed, in sterile conditions, internally of one or more casings.

In the case of pharmaceutical containers constituted by syringes or also vials, the support elements can consist in the combination of two elements: a first element, called a nest, for the support of the syringes or vials, and a second element, called a tub, in which the nest is positioned.

The nest is a sort of rack having a plurality of through-seatings having a shape and dimensions that are such as to support the syringes or the vials, while the tub is a tray in which the nest is inserted.

The syringes or vials are inserted and housed in the seatings of the nest in such a way that the relative mouths for the inserting of the pharmaceutical substance or product are facing upwards.

FIG. 1A illustrates one of the support elements (E) comprising a tub (T) with a relative nest (N) in which a plurality di syringes (S) is predisposed and housed.

The tubs, with the nests bearing the syringes or vials, are sealed by use of a protective film and then are packed in sterile conditions internally of one or more casings.

Pharmaceutical producers then receive these types of sterile packages, with the pharmaceutical containers inside predisposed in the relative support elements, constituted by trays or by the tubs with the nests internally thereof.

They then proceed to opening the packages, opening the casings and removing the sealing film, extracting the support elements of the pharmaceutical containers and then to the removal of the pharmaceutical containers from the support elements in order to fill them, close them and seal them.

For this purpose, special automatic machines are used, which are predisposed to carry out the operations as above-mentioned in a controlled-atmosphere environment, in particular sterile, to avoid contaminations of the pharmaceutical substances or products.

Usually machines for filling and closing pharmaceutical containers comprise a conveyor means for receiving and transporting the support elements, containing the pharmaceutical containers, once the support elements have been extracted, for example manually by an operator, from the relative sterile packages and the protective film removed.

These machines have a work environment which is maintained with a controlled atmosphere and sterile conditions, for example by means of laminar flows directed from above downwards, internally of which the container filling and closing operations take place.

The work environment is provided with an inlet passage and an outlet passage, to enable passage of the conveyor means which transport the support elements of the pharmaceutical containers.

The conveyor means is predisposed and configured with respect to this work environment and has a length that is such as to comprise:

a first portion externally of the work environment and upstream of the inlet passage, at which the support elements of the pharmaceutical containers are rested once they have been extracted from the sterile packages;

a second portion internally of the work environment, between the inlet passage and the outlet passage;

and a third portion externally of the work environment downstream of the outlet passage.

At present the known filling machines and the closing of the pharmaceutical containers are conceived and structured substantially according to a same common lay-out, as described in the following.

Internally of the work environment, flanked to or at the second portion of the conveyor means, and between the inlet passage and the outlet passage, the following are present:

a collecting station, for picking up the support elements from the second portion of the conveyor means and for positioning thereof in a paused position, first transfer means, for picking up the pharmaceutical containers from the support elements in the paused position, and for transfer thereof to a filling station, which comprises filling means for carrying out the filling of the containers with pharmaceutical substances or products, a closing station, comprising means for carrying out the closing of the containers with caps or appropriate closing elements, and second transfer means, for transferring the filled and newly closed containers to the support elements which, in the meantime, had been returned onto the second portion of the conveyor means.

In this way, the filled and closed containers are newly repositioned in the support elements which, during the filling and closing operations, had remained inside the work environment.

Subsequently the conveyor means is activated to transport and convey the support elements, with the filled and closed containers, to outside the work environment, through the outlet passage, for subsequent operations of packing the filled and closed containers in relative final packs.

For example, a first type of machine (N1) of the prior art known by the Applicant and at present used for filling and closing pharmaceutical containers has the structure and lay-out illustrated in FIG. 1B.

This machine (N1) comprises a conveyor means (A) predisposed to receive and transfer the support elements (E), which internally contain the pharmaceutical containers to be filled and closed, once extracted from the relative sterile packages, and a work environment (L1) in a controlled atmosphere and thus kept in sterile conditions.

The work environment (L1) comprises an inlet passage (11) and an outlet passage (O1) and the conveyor means (A) is configured and predisposed in such a way as to cross the inlet passage (11) and the outlet passage (O1), so as to have a first portion (A1) outside the work environment (L1), upstream of the inlet passage (11), a second portion (A2) inside the work environment (L1), and a third portion (A3) outside the work environment (L1), downstream of the outlet passage (O1).

The conveyor means (A) then transports the support elements (E), with the containers to be filled, internally of the work environment (L1) at the relative second portion (A2).

The machine (N1) also comprises, internally of the work environment (L1), a filling station (R1), which is provided with means for carrying out the filling of the containers, at least a closing station (C1), provided with means for applying a closing and/or sealing element to the containers when filled.

For this purpose, the machine (N1) is provided, in the work environment (L1), with a conveyor (H1) provided with appropriate retaining elements for retaining and transporting the containers so as to convey them and cause them to transit at the filling station (R1) and the closing station (C1).

For example, in the configuration of the machine (N1) illustrated in FIG. 1B, the conveyor (H1) is arranged transversally with respect to the conveyor means (A) of the support elements (E) of the containers.

The machine (N1) further comprises first transfer means (not illustrated in detail) which are located internally of the work environment (L1) and which are predisposed and configured in such a way as to collect the support elements (E) from the second portion (A2) of the conveyor means (A) and transfer the support elements (E) into a first paused position (W) neared to the conveyor (H1) and then to pick up the containers and position them at the retaining elements of the conveyor (H1).

For example, in the case of support elements (E) constituted by tubes and nests, the first transfer means are predisposed to pick up the nest with the containers from the tub and transfer the nest into the first paused position (W) neared to the conveyor (H1), so that the containers can then be picked up from the nests and transferred to the retaining elements of the conveyor (H1).

In this case, the nests emptied by the containers are advanced transversally to the conveyor (H1) into a second paused position (W'), still internally of the work environment (L1) while newly awaiting the containers once filled and closed.

In this regard the machine (N1) has second transfer means (not illustrated in detail) predisposed to pick up, from the conveyor (H1), the filled and closed containers and reposition them in the nests.

The nests are then newly transferred and positioned on the second portion (A2) of the conveyor means (A) which transports them externally of the work environment (L1) through the outlet passage (O1).

In this configuration and arrangement, however, in the prior art machine (N1), the support elements (E) (for example both the tubs and the nests, or even the trays) remain inside the work environment (L1), and are moved and displaced at positions (the two paused positions) which are in the vicinity of the zones and areas in which the container filling and closing operations take place.

The presence, and especially the movement and displacement of the support elements, made of a plastic material, constitutes a possible source of contamination, as small particles or powders can be released which might deposit on the containers or contaminate the pharmaceutical substance or product inserted therein, before closure thereof.

A further machine (N2) for filling and closing known pharmaceutical containers is the one illustrated in FIG. 1C; this machine (N2) is described in document WO2016198391.

In this case too, the machine (N2) comprises a conveyor means (B) for receiving and conveying the support elements (E) of the pharmaceutical containers, which are constituted by tubs (T) with the nests (N) containing syringes or vials with a mouth for inserting the pharmaceutical substance or product facing upwards, and a work environment (L2) under a controlled atmosphere and thus maintained in sterile conditions.

The work environment (L2) comprises an inlet passage (E1) and an outlet passage (E2) and the conveyor means (A) is configured and predisposed in such a way as to cross the inlet passage (E1) and the outlet passage (E2), so as to have a first portion (B1) outside the work environment (L2), upstream of the inlet passage (E1), a second portion (B2) inside the work environment (L2), and a third portion (B3) outside the work environment (L2), downstream of the outlet passage (E2).

The conveyor means (B) then transports the support elements (E), with the containers to be filled, internally of the work environment (L2) at the relative second portion (B2).

The machine (N2) also comprises, internally of the work environment (L2), a filling station (R2), which is provided with means for carrying out the filling of the containers, at least a closing station (C2), provided with means for applying a closing element of the containers once filled, and a station (G) for application of a ring at and above the closing element of the containers.

For this purpose, the machine (N2) is also provided inside the work environment (L2) with first transfer means (M1) which are located internally of the work environment (L2) and which are predisposed and configured so as to pick up the nests (N) with the containers to be filled from the tubs (T), which have been brought into a waiting position at the second portion (B2) of the conveyor means (B), and transfer the nests (N) into a first paused position (W1) near the filling station (R2).

The containers are then picked up from the nests and brought to the filling station (R2) and then the closing station (C2), by means of handlers.

The nest (N) remains in the first paused position (W1) in proximity of the filling station (R) and the closing station (C) until all the containers have been picked up by the handlers.

Once emptied, the nest (N) is returned by the first transfer means (M1) to the tub (T) which was waiting on the second portion (B2) of the conveyor means (B2) and advanced up to a position, again along the second portion (B2) of the conveyor means (B) internally of the work environment (L2), facing the ring application station (G).

The nests (N) are newly picked up from the second transfer means (M2) and are transferred to a second paused position (W2) in the vicinity of the ring application station (G).

Once filled and closed, the containers are transferred by a handler onto a carousel which transfers them to the station (G) for application of the rings and then transfers them and inserts them in the nests (N) in the second paused position (W2).

Once the nests (N) have been filled with the filled containers, closed and sealed with the rings, they nests are newly transferred into the tubs (T) waiting on the second portion (B2) of the conveyor means (B)

The conveyor means (B) will then transfer the tubs out of the work environment (L2), through the outlet passage (E2).

In this configuration of the machine (N2) too, however, both the nests and the tubs remain internal of the work environment (L2), and are moved and displaced at positions (the two paused positions) which are in the vicinity of the zones and areas in which the container filling and closing operations take place.

Consequently, in this case too, the presence, and especially the movement and displacement of the support elements (tub and nest), made of a plastic material, constitutes a possible source of contamination, as small particles or powders can be released which might deposit on the containers or contaminate the pharmaceutical substance or product inserted therein, before closure thereof.

SUMMARY OF THE INVENTION

An aim of the present invention is therefore to describe a machine for filling and closing pharmaceutical containers, such as syringes, vials and the like, positioned in groups in relative support elements, able to obviate the above-described drawbacks present in the machines of the prior art.

In particular, an aim of the present invention is to disclose a machine for filling and closing pharmaceutical containers which is conceived and structured according to a particular lay-out, i.e. according to a particular arrangement of the various elements and stations thereof, so as to enable carrying out the filling and closing operations of the pharmaceutical containers in total safety and preventing the movement of the support elements of the containers, such as tubs, nests or trays, which can be a cause of contaminations for the pharmaceutical substances or products that can be, inserted in the containers.

The above aims are obtained by a machine for filling and closing pharmaceutical containers, such as syringes, vials and the like, according to claim 1.

BRIEF DESCRIPTION OF THE DRAWINGS

The characteristics of a preferred, but not exclusive, embodiment of the machine for filling and closing pharmaceutical containers, such as syringes, vials and the like of the present invention will be described in the following with reference to the appended tables of drawings, in which.

DESCRIPTION OF THE PREFERRED EMBODIMENTS

Figure 2:
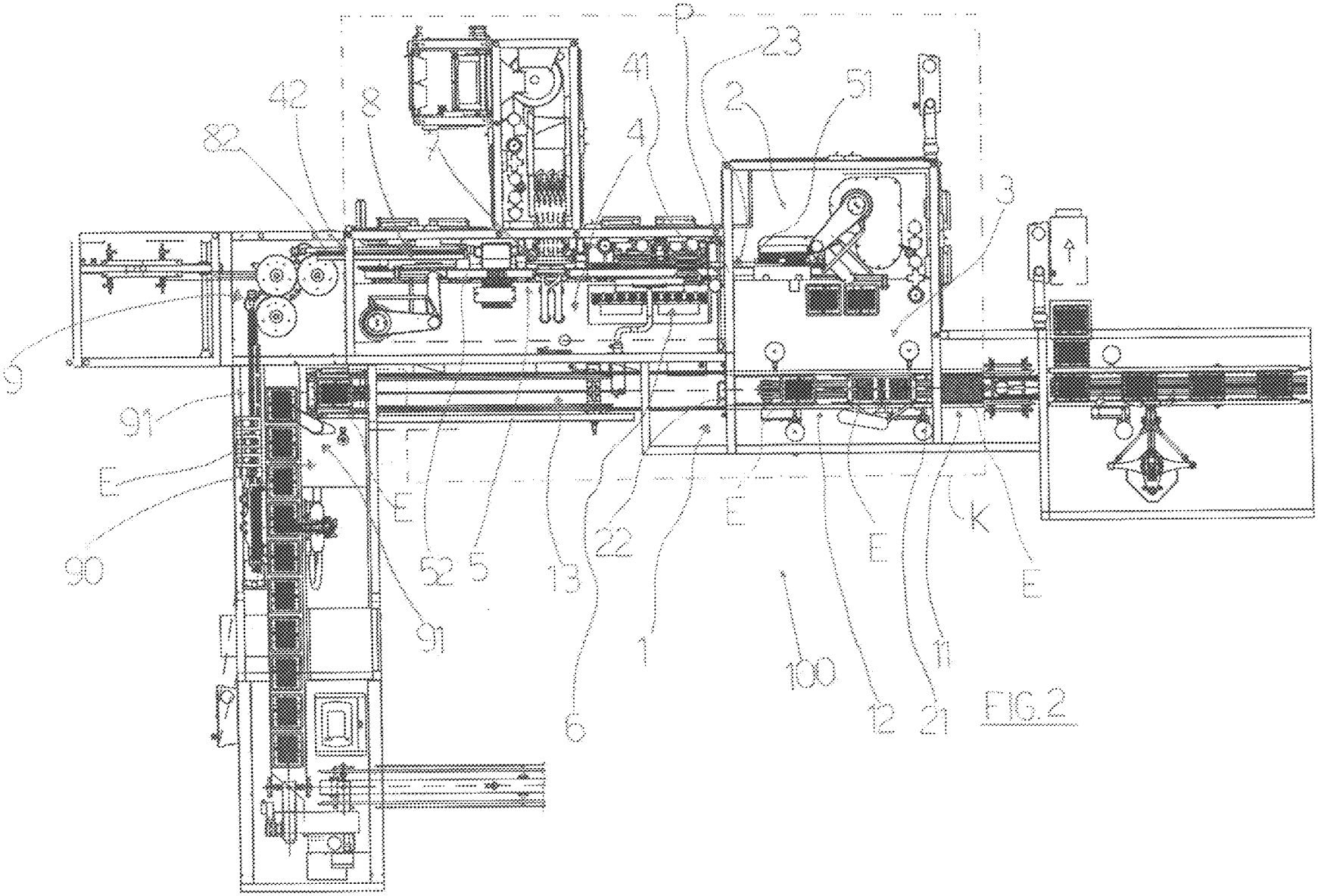
FIG. 2 illustrates, in a schematic plan view, the detailed lay-out arrangement and configuration of the machine for filling and closing pharmaceutical containers, such as syringes, vials and the like, positioned internally of relative support elements, of the present invention.
Figure 3:
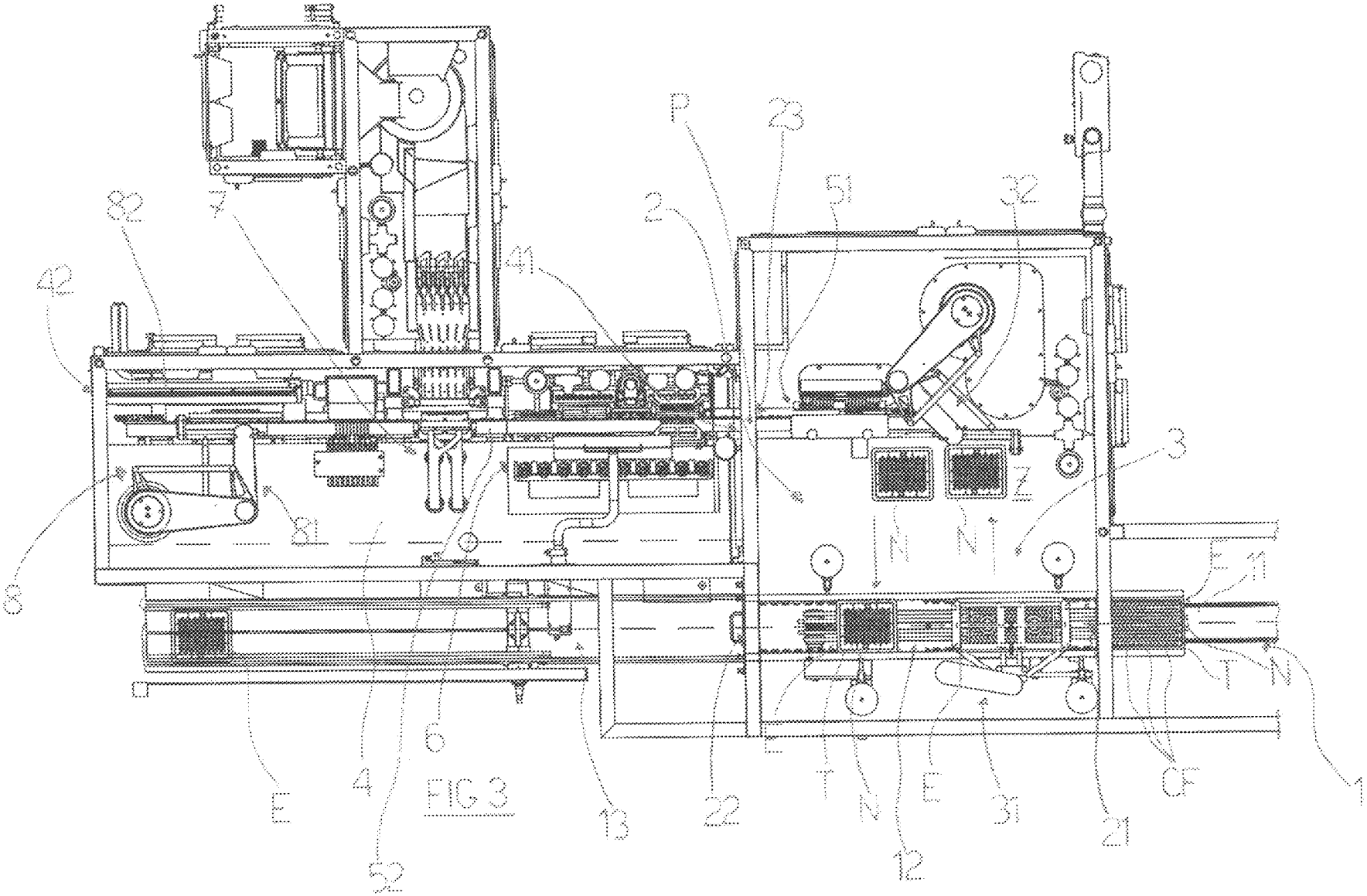
FIG. 3 is a larger-scale illustration of detail K of FIG. 2.

With reference to the appended tables of drawings, in particular FIGS. 2 and 3, reference numeral (100) denotes the machine for filling and closing pharmaceutical containers, such as syringes, vials and the like of the present invention.

Figure 1A:
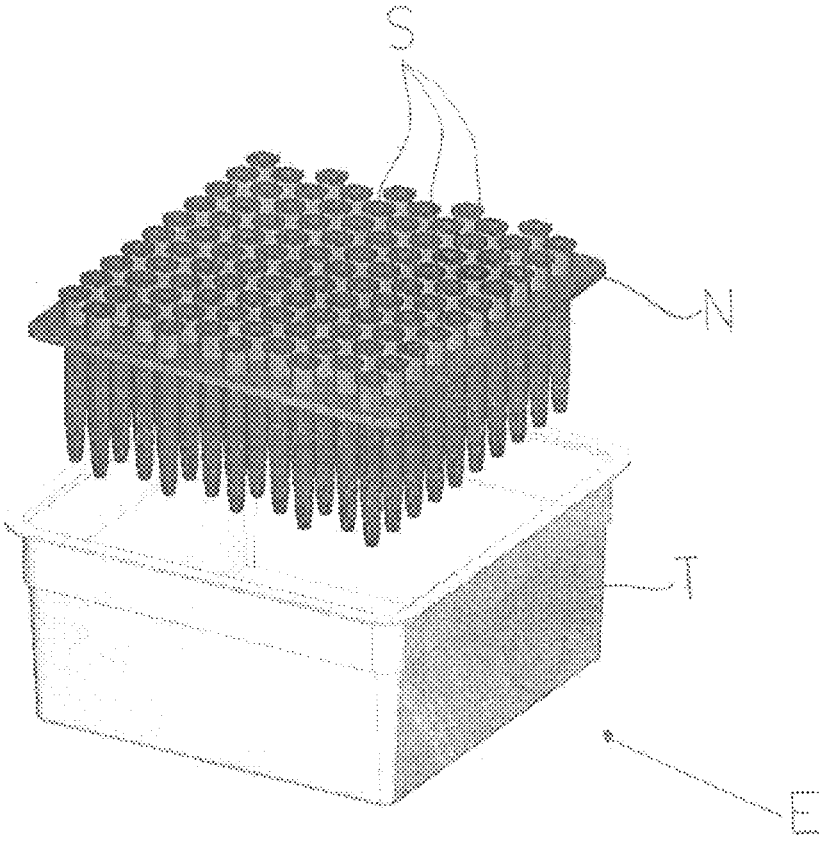
FIG. 1A, already mentioned in the foregoing, illustrates, in a perspective and exploded view, a support element of pharmaceutical containers to be filled and closed, such as for example syringes, support element comprising a nest for receiving and supporting a plurality of syringes with an upwards-facing mouth for inserting the pharmaceutical substance or product, and a tub in which the nest with the syringes is positioned and supported.
Figure 1B:
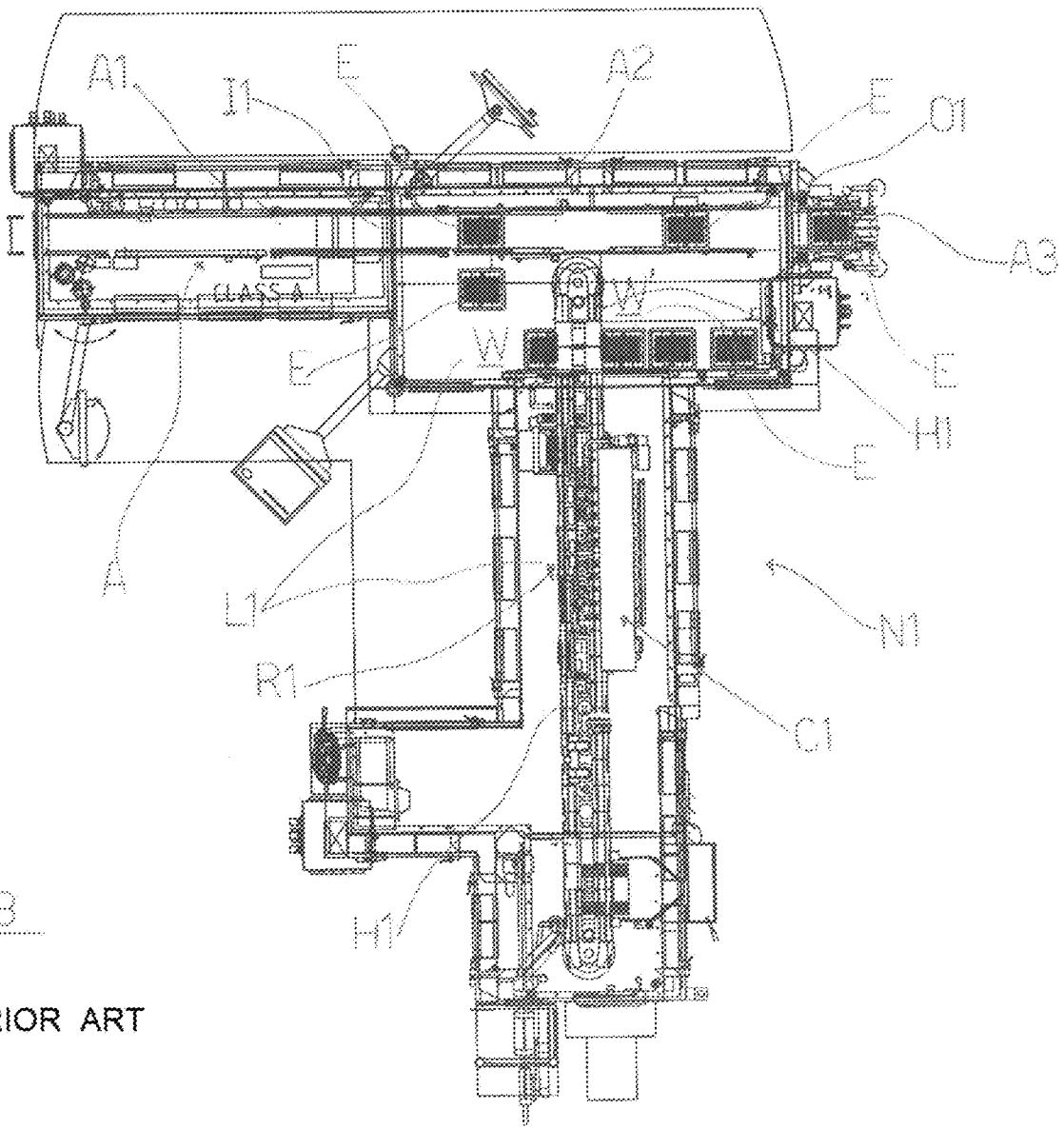
FIG 1B PRIOR ART
FIGS. 1B and 1C, also mentioned in the foregoing, illustrate, in respective plant views, two types of machines for filling and closing pharmaceutical containers of known type.
Figure 1C:
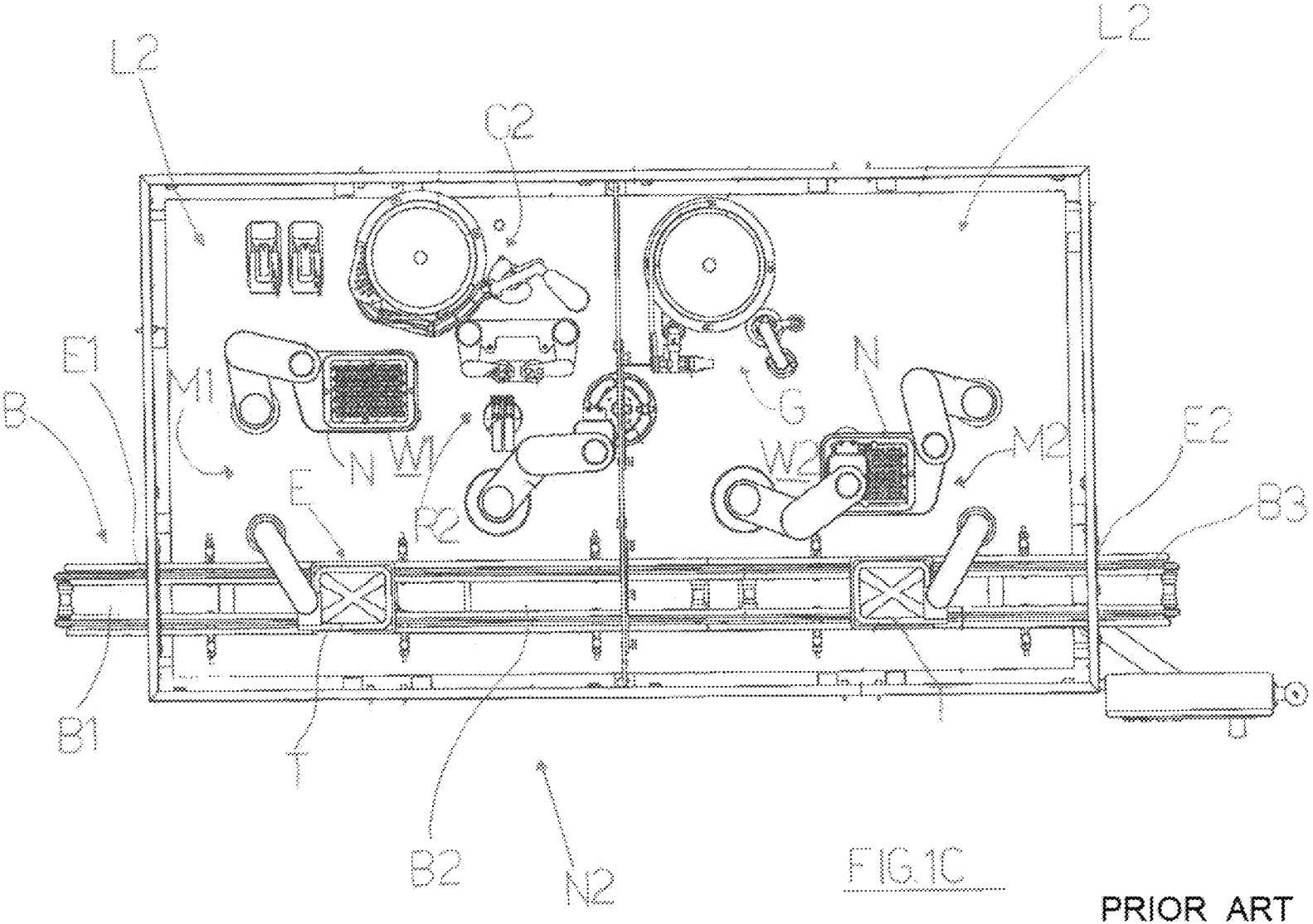
PRIOR ART FIG.1C

As mentioned in the foregoing, the pharmaceutical containers (CF) to be filled and closed are arranged in relative support elements (E), being trays, or are arranged in nests (N) inserted into relative tubs (T), as illustrated in FIG. 1A.

The machine (100) of the invention is predisposed to operate with both types of support elements.

The machine (100) comprises a conveyor means (1) predisposed for receiving and conveying the support elements (E) of the pharmaceutical containers, and a work environment (2) which is maintained, in known ways, in a controlled and sterile atmosphere comprising an inlet passage (21) and an outlet passage (22).

The conveyor means (1) is arranged with respect to the work environment (2) and is configured so as to have a length that is such as to cross the work environment (2) through the inlet passage (21) and the outlet passage (22) and to have: a first portion (11) externally of the work environment (2) and upstream of the inlet passage (21), for receiving the support elements (E) of the pharmaceutical containers which are to be filled with pharmaceutical substances or products and then closed, a second portion (12) internally of the work environment (2), between the inlet passage (21) and the outlet passage (22), to which the conveyor means (1) conveys and positions the support elements (E) of the pharmaceutical containers to be filled and closed, and lastly a third portion (13) externally of the work environment (2) downstream of the outlet passage (22).

The machine (100) further comprises a collecting station (3) located internally of the work environment (2), which is predisposed and configured for collecting and extracting the pharmaceutical containers from the support elements (E) which have been conveyed by the conveyor organ (1) through the inlet passage (21) at the relative second portion (12).

The peculiarities of the machine (100) for filling and closing the pharmaceutical containers of the present invention consist in the fact that the work environment (2) further comprises a second outlet passage (23) and the machine (100) further comprises a second work environment (4) maintained in a controlled and sterile atmosphere.

In particular, the second work environment (4) comprises and inlet (41) and an outlet (42), and is predisposed with respect to the work environment (2) in such a way that the inlet (41) is at the second outlet passage (23) of the work environment (2) so as to identify a common passage (P) between the two work environments (2, 4)

The machine (100) also comprises a conveyor (5) which is predisposed and positioned so as to pass through the common passage (P) and to have a first part (51) located internally of the work environment (2) and a second part (52) which is located internally of the second work environment (4).

The conveyor (5) is configured and predisposed so that the first part (51) (located internally of the work environment (2)) can receive the pharmaceutical containers extracted from the support elements (E) at the collecting station (3) and so that the pharmaceutical containers can be conveyed through the common passage (P) internally of the second work environment (4) at, and along, the second part (52) of the conveyor (5).

For example, the conveyor (5) can be provided with special retaining elements or seatings (not illustrated in detail as of known type) in which the containers can be positioned and retained during transport thereof along the conveyor (5), from the first part (51) internally of the work environment (2) to the second part (52), through the common passage (P), and along the second part (52) internally of the second work environment (4).

The machine (100) is provided and equipped with:

a filling station (6), located internally of the second work environment (4), for carrying out the filling of the pharmaceutical containers conveyed by the second part (52) of the conveyor (5) with pharmaceutical substances or products, a closing station (7), also located internally of the second work environment (4), for applying a closing element on the pharmaceutical containers once filled.

Lastly, the machine (100) comprises extraction means (8), which are predisposed for collecting the pharmaceutical containers that have been filled and closed from the conveyor (5) and for transporting the containers externally of the second work environment (4) through the relative outlet (42).

Owing to these special characteristics, in particular the presence of the second work environment (4) having a controlled and sterile atmosphere which is arranged so as to have a common passage (P) with the work environment (2), and the presence of the conveyor (5) which is predisposed so as to pass through the common passage (P) and to have a first part (51) located internally of the work environment (2) and a second part (52) located internally of the second work environment (4), in the machine (100) of the invention, the pharmaceutical containers, once extracted from the relative support elements at the collecting station (3) in the work environment (2), can be transferred internally of the second work environment (4) and be filled and closed there.

In this way, the filling and closing of the pharmaceutical containers can take place in a sterile work environment that is entirely separated and distinct from the work environment in which the support elements are positioned and moved.

This contributes to preventing the onset of possible contaminations during the filling operations of the pharmaceutical containers, due to an eventual release of powders or particles caused by the movement of the support elements.

Other advantageous characteristics of the machine (100) of the present invention are set out in the following.

As mentioned in the foregoing, the machine (100) is predisposed to be able to operate both when the pharmaceutical containers are arranged in support elements (E) constituted by nests (N) inserted in and borne by relative tubs (T), and when the pharmaceutical containers are arranged in trays.

For example, FIGS. 2 and 3 illustrate a preferred embodiment of the machine (100) of the invention in the case of support elements (E) constituted by nests (N) which bear a plurality of pharmaceutical containers (CF), such as for example syringes or vials and a tub (T) in which the nest (N) is positioned.

In this particular embodiment, the collecting station (3) comprises: transfer means (31), which are predisposed for collecting the nests (N) from the tubs (T) of the support elements (E) which have been conveyed by the conveyor means (1) through the inlet passage (21) to the relative second portion (12) internally of the work environment (2) and for positioning the nests (N) at a paused position (Z) in proximity of the first part (51) of the conveyor (5).

The collecting station (3) also comprises handling organs (32) which are predisposed and configured for collecting the pharmaceutical containers from the nests positioned in the paused position (Z) and transfer the containers onto the first part (51) of the conveyor (5).

The transfer means (31) are also predisposed for collecting the nests (N) from the paused position (Z), once emptied of the pharmaceutical containers, and for newly transferring the containers into the tubs (T) present on the second portion (12) of the conveyor means (1).

In this way, the conveyor means (1) can convey the support elements (E), once emptied, externally of the work environment (2) through the outlet passage (22) and along the relative third portion (13).

Alternatively, in a case where the pharmaceutical containers are arranged in support elements constituted by trays, the transfer means of the collecting station (3) will be configured and predisposed to extract the pharmaceutical containers directly from the trays, which have been conveyed by the conveyor means (1) through the inlet passage (21) to the relative second portion (12) internally of the work environment (2) and for positioning the pharmaceutical containers at a paused position (Z) in proximity of the first part (51) of the conveyor (5).

In this case too, the collecting station (3) will be provided with special handling organs (32) predisposed and configured for collecting the pharmaceutical containers from the paused position (Z) and transferring the containers onto the first part (51) of the conveyor (5).

In the meantime, the conveyor means (1) can convey the trays, once emptied, externally of the work environment (2) through the outlet passage (22) and along the relative third portion (13).

In the preferred but not exclusive embodiment illustrated in FIGS. 2 and 3, the extraction means (8) comprise gripping means (81), predisposed for collecting the pharmaceutical containers that have been filled and closed from the conveyor (5), and a screw transport member (82) for receiving the pharmaceutical containers from the gripping means (81) and for conveying the pharmaceutical containers externally of the second work environment (4) through the relative outlet (42).

The machine (100) can advantageously comprise, as illustrated schematically in FIG. 2, a sorting station (9), arranged downstream of the outlet (42) of the second work environment (4).

The sorting station (9) is predisposed for receiving the filled and closed pharmaceutical containers from the extraction means (8) and for transferring the pharmaceutical containers to a packing station (90).

According to the illustrated preferred embodiment, the machine (100) is designed and structured so that the third portion (13) of the conveyor means (1) can be configured for conveying the support elements (E), once emptied of the pharmaceutical containers, up to the packing station (90).

In this way, according to the ways in which the packaging of the pharmaceutical containers, once filled and closed, it will be possible to reposition the filled and closed containers internally of the support elements (E):

For this purpose, the machine (100) can be configured so that the packing station (90) comprises pick up and place organs (91) which are predisposed for collecting the pharmaceutical containers supplied by the sorting station (9) and inserting the pharmaceutical containers internally of the support elements (E).

The invention claimed is:

1. A machine for filling and closing pharmaceutical containers, arranged in respective support elements, comprising:

a conveyor means predisposed for receiving and conveying the support elements of the pharmaceutical containers;

a work environment in a controlled and sterile atmosphere comprising an inlet passage and an outlet passage, the conveyor means being arranged with respect to the work environment and having a length that is such as to cross the work environment through the inlet passage and the outlet passage and to have: a first portion externally of the work environment and upstream of the inlet passage, for receiving the support elements of the pharmaceutical containers which are to be filled with pharmaceutical substances or products and then closed, a second portion internally of the work environment, between the inlet passage and the outlet passage, to which the conveyor means conveys and positions the support elements of the pharmaceutical containers to be filled and closed, and a third portion externally of the work environment downstream of the outlet passage, a collecting station internally of the work environment and predisposed and configured for collecting and extracting the pharmaceutical containers from the support elements which have been conveyed by the conveyor means through the inlet passage at the relative respective second portion, wherein the work environment comprises a second outlet passage and in that it comprises a second work environment in a controlled and sterile atmosphere comprising an inlet and an outlet, the second work environment being predisposed with respect to the work environment in such a way that the inlet is at the second outlet passage of the work environment so as to identify a common passage between the two work environments, and in that it comprises:

a conveyor predisposed and positioned so as to pass through the common passage and to have a first part located internally of the work environment and a second part located internally of the second work environment, and predisposed so that the first part can receive the pharmaceutical containers extracted from the support elements at the collecting station and in that the pharmaceutical containers can be conveyed through the common passage internally of the second work environment at, and along, the second part of the conveyor, a filling station, internal of the second work environment, for carrying out the filling of the pharmaceutical containers conveyed by the second part of the conveyor with pharmaceutical substances or products, a closing station, internal of the second work environment, for applying a closing element on the pharmaceutical containers once filled, extraction means, predisposed for collecting the pharmaceutical containers that have been filled and closed from the conveyor and for transporting the containers externally of the second work environment through the respective outlet.

2. The machine of claim 1, wherein the support elements of the pharmaceutical containers comprise a nest which bears a plurality of pharmaceutical containers and a tub in which the nest is positioned, and in that the collecting station comprises: transfer means predisposed for collecting the nests from the "tubs" of the support elements which have been conveyed by the conveyor means through the inlet passage to the relative respective second portion internally of the work environment and for positioning the nests at a paused position in proximity of the first part of the conveyor, and handling organs predisposed and configured for collecting the pharmaceutical containers from the nests positioned in the paused position and transfer the containers onto the first part of the conveyor, the transfer means also being predisposed for collecting the nests, once emptied of the pharmaceutical containers, and for transferring the containers newly into the tubs present on the second portion of the conveyor organ.

3. The machine of claim 1, wherein the support elements of the pharmaceutical containers comprise a tray and the pharmaceutical containers are arranged internally of the tray, and in that the collecting station comprises transfer means for extracting the pharmaceutical containers from the trays which have been conveyed by the conveyor means through the inlet passage to the respective second portion internally of the work environment and for positioning the pharmaceutical containers at a paused position in proximity of the first part of the conveyor, and handling organs predisposed and configured for collecting the pharmaceutical containers from the paused position and transferring the containers onto the first part of the conveyor.

4. The machine according to claim 1, wherein the extraction means comprise gripping means, predisposed for collecting the pharmaceutical containers that have been filled and closed by the conveyor, and a screw transport member for receiving the pharmaceutical containers from the gripping means and for conveying the pharmaceutical containers externally of the second work environment through the respective outlet.

5. The machine according to claim 1, further comprising a sorting station, downstream of the outlet of the second work environment, predisposed for receiving the filled and closed pharmaceutical containers from the extraction means and for transferring the pharmaceutical containers to a packing station.

6. The machine of claim 5, wherein the conveyor means is configured for conveying the support elements, once emptied of the pharmaceutical containers, externally of the work environment through the outlet passage and along the respective third portion up to the packing station, and in that the packing station comprises pick up and place organs predisposed for inserting the filled and closed pharmaceutical containers newly internally of the support elements.

* * * * *